United States Patent [19]

Johnson

[11] 4,204,946

[45] May 27, 1980

[54] PROCESS FOR REMOVING METAL CONTAMINANTS FROM USED LUBRICATING OILS

[75] Inventor: Conrad B. Johnson, Edmonton, Canada

[73] Assignee: Turbo Resources Ltd., Edmonton, Canada

[21] Appl. No.: 11,093

[22] Filed: Feb. 12, 1979

[51] Int. Cl.[2] ..... C10M 11/00

[52] U.S. Cl. ..... 208/181

[58] Field of Search ..... 208/181, 179, 253

[56] References Cited

U.S. PATENT DOCUMENTS

| | | | |
|---|---|---|---|
| 3,222,275 | 12/1965 | Krewer et al. | 208/181 |
| 3,879,282 | 4/1975 | Johnson | 208/180 |
| 4,097,369 | 6/1978 | Ebel et al. | 208/181 |

*Primary Examiner*—George Crasanakis

*Attorney, Agent, or Firm*—Ernest Peter Johnson

[57] ABSTRACT

A process is provided for removing metal contaminants from used lubricating oil. The used oil is contacted with an aqueous solution of aluminum sulphate and ammonium sulphate at elevated temperature to form compounds of the metal contaminants in an aqueous phase which is phase separable from the oil. An oil product reduced in metal contaminants is thereby produced which is suitable as a cheap fuel or lubricant.

7 Claims, 1 Drawing Figure

PROCESS FOR REMOVING METAL CONTAMINANTS FROM USED LUBRICATING OILS

BACKGROUND OF THE INVENTION

The present invention relates to a process for removing metal contaminants from waste lubricating oil and in particular to the removal of metal contaminants by contacting the waste oil with an aqueous solution of salts to render the contaminants phase separable.

Waste lubricating oils include those oils which, having been used as lubricant or motor oils, contain impurities associated with their use. The major contaminants include metals such as zinc which is added to the oil with antiwear agents, and lead which, as a gasoline additive, contaminates the oil. Calcium is present in the oil arising from the addition of detergents. Iron accumulates in the oil as a result of wear on the engine parts. Since large volumes of these used oils exist, a better process is needed for removing the metal contaminants to provide a useful oil product which is suitable as a cheap fuel or lubricant.

It has previously been known to reprocess waste lubricating oil by contacting the oil with sulphuric acid, thereby forming an acid sludge with the contaminants, which is separated from the oil. This method suffers the disadvantage of low yields of refined oil, losing up to 20% of the original starting oil. Disposal of the acid sludge has also created environmental problems.

Other methods have been proposed for reprocessing waste oil by obtaining a methathesis reaction with the metal contaminants by adding an aqueous solution of reagents which precipitate the metals to render them phase separable from the oil. In accordance with these schemes, aqueous solutions of sodium silicate or sodium hydroxide have been used to precipitate the metals into an aqueous layer separable from the remaining oil phase. These reagents have not been found satisfactory in the past since the sodium ion has an emulsifying effect and forms powerful detergents with the organics—this keeps the oil and aqueous layers inseparable.

According to U.S. Pat. No. 3,930,988, issued to Johnson, used motor oils may be contacted with an aqueous solution of ammonium sulphate and/or ammonium bisulphate to precipitate the metal contaminants into an aqueous phase separable from the oil phase. This system requires highly acidic conditions to effectively remove the contaminants and is thus subject to corrosive problems associated with the low pH.

SUMMARY OF THE INVENTION

The process of the present invention was devised to overcome the abovementioned problems and is based on a number of findings. Firstly, it was found that aqueous solutions of the sulphates of ammonium and aluminum were effective in the removal of metal contaminants from the used oil. While not being bound by same, the mechanism of this process appears to be as follows: the ammonium or aluminum ions added to the oil are able to replace the metal contaminants complexed with the organics or form mixed metal compounds with the metal contaminants to either precipitate the contaminants into an aqueous phase or form water soluable salts with the contaminants to thereby render the metals separable from the oil in an aqueous layer.

In examining the reaction conditions for the most efficient removal of the contaminants or ash, it was found that temperature, pressure and pH were important parameters. In particular it was surprising to note that temperature and pressure changes alone did not increase ash removal. However, in adjusting the pH of the reaction at elevated pressure and temperature it was found that pH affected the ammonium and aluminum sulphate systems in an opposite manner. In treating the oil with ammonium sulphate, the efficiency of ash removal increased as the pH of the system was lowered while with the aluminum sulphate system ash removal was enhanced as the pH was increased.

Following this discovery, the aluminum sulphate and ammonium sulphate were combined in the treatment of the used oil, with the view that a pH intermediate that of the two systems would be achieved to effect an increase in ash removal. In fact, in practice, a large increase in ash removal was effected with the mixed sulphate system. It is believed that the mechanism here is synergistic in nature, employing the different affinities of the ammonium and aluminum ions for the anions with which the metals are complexed.

The results of the above findings are summarized in Table I.

In accordance with the present invention a process is provided for removing metal contaminants from used lubricating oil by contacting the oil with an aqueous solution of ammonium sulphate and aluminum sulphate at elevated temperature to render the metal contaminants phase separable from the oil.

It is a preferred feature of the invention to employ aqueous solutions of the sulphates having a pH of approximately 3.5 to 4.0. This pH range, in addition to increasing the efficiency of ash removal, reduces the corrosive problems associated with high acidity systems.

It is another preferred feature of the invention to use reaction conditions wherein the oil is contacted at temperatures of approximately 212° F. to 500° F. is a closed vessel and the pressures are those resulting from the saturated steam atmosphere.

A further preferred condition of the invention involves contacting the used oil with an aqueous solution of about three molar parts of ammonium sulphate and about one molar part of aluminum sulphate.

Broadly stated, the invention is a process for removing metal contaminants from used lubricating oil comprising: contacting the lubricating oil with an aqueous solution of ammonium sulphate and aluminum sulphate in a closed vessel at elevated temperature to form compounds of the metal contaminants separable from the oil in an aqueous phase; and separating said aqueous phase from the lubricating oil to provide an oil product reduced in metal contaminants.

DESCRIPTION OF THE PREFERRED EMBODIMENT

Figure 1:
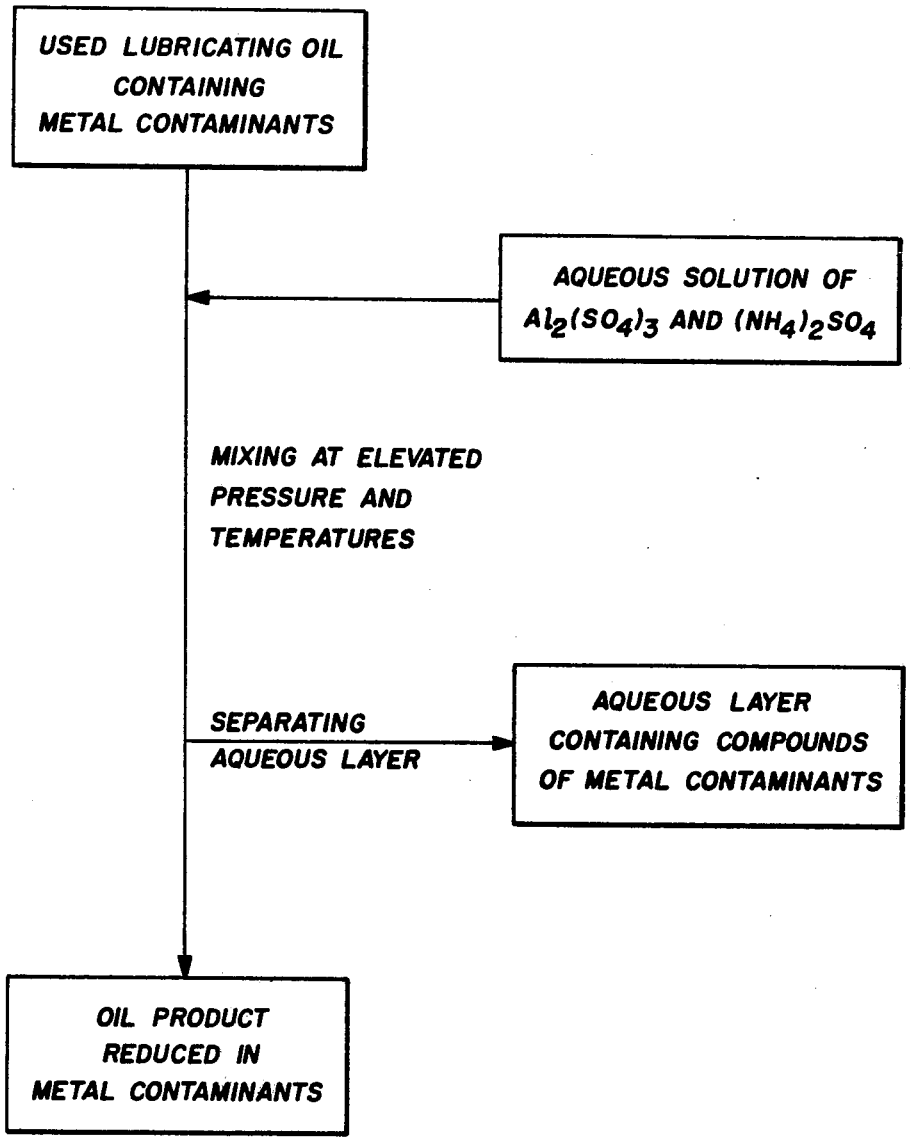
FIG. 1 is a block diagram illustrating the preferred form of the present invention.

The process of the present invention is directed toward treating a used lubricating oil feedstock which is largely derived from the discard oils accumulated at gasoline stations. Included in these oils may be motor oils, crankcase oils, transmission oils, hydraulic oils and the like. Metal contaminants are contained in these oils largely due to antiwear and detergent agents added prior to the use of the oil, gasoline additives, and wear metals which result from the wear of engine parts. The major metals present include lead, zinc, calcium and iron and are usually present in concentrations of about 1–2% by weight of the oil.

In the practice of the invention the used lubricating oil is contacted with an aqueous solution of aluminum sulfate and ammonium sulphate at elevated temperature and pressure. Preferably this involves mixing the used oil and aqueous solutions at high speeds in a closed pressure vessel, such as an autoclave, at a temperature in the range of 200° F. to 500° F. More preferably operating conditions include a temperature in the range of 212° F. to 500° F. and a pressure which results from a saturated steam atmosphere at that temperature in the closed vessel.

The aqueous solution preferably contains pretreatment reagents in excess of the concentration of the metal contaminants in the used oil; that is, the reaction mixture contains aluminum sulphate and ammonium sulphate in excess of the 1–2% by weight of metal contaminants in the used oil, in order to ensure a sufficient quantity of the reagents to replace or combine with the metals to be removed.

Most preferably, an aqueous solution of about three molar parts of ammonium sulphate to about one molar part of aluminum sulphate, having a pH in the range of about 3.5–4.0, is used.

The elevated temperature and pressure conditions used for the reaction are generally governed by economics. The lowest temperature used is essentially limited by the boiling point of water, this being necessary to effect a replacement and/or complexing action of the aluminum and ammonium sulfate with the metal contaminants in the oil. Beyond 500° F., problems associated with the high energy input and the containment of very high pressures are no longer feasible since little gain in metal removal is achieved.

After about a one hour contacting period, the aqueous and oil layers are separated. This can be achieved by gravity or centrifugal separation. The aqueous layer, containing the compounds of the metal contaminants, is discarded, leaving a low grade oil product reduced in metal contaminants which can be further processed or used as a cheap fuel or lubricant. Additionally, any metal compounds which may accumulate at the aqueous-oil interfere are separated with the aqueous layer.

The scheme of the invention is illustrated in FIG. 1.

The invention is further illustrated by the following example.

Oil samples were taken from a feedstock of used lubricating oil and subjected to various treatments to be described herein. This feedstock oil contained 1–2% by weight metal contaminants, and pretreatment chemicals were added in excess of this amount. In order to obtain samples of oil which were substantially uniform in ash content, the feedstock was agitated with a stream of nitrogen before extracting a number of 300 ml. oil samples. To each sample was added 100 ml. of an aqueous solution containing 0.2 moles of the pretreatment chemicals. This mixture was placed in a pressure vessel equipped with a mechanical stirrer, pressure gauge and heating mantle. The vessel was sealed, and the contents heated to 375° F. with stirring at 600 rpm for one hour. The rise in temperature resulted in a saturated steam atmosphere having a pressure of 300 psig. The mixture was cooled without stirring and allowed to gravity separate for 24 hours into ageous and oil layers. The oil layer was then decanted to provide an oil product reduced in metal contaminants.

Various treatments were performed, varying the pretreatment chemicals, molar ratios of the pretreatment chemicals and the pH of the aqueous solution to demonstrate the effect of these parameters on the metal removal. The pH measurements were accurate to about 0.3 pH units. The results are summarized in Table 1.

Determination of the metal content of the oil samples was performed gravimetrically prior to and after the treatments. The physical properties of the ash residue obtained after igniting each reprocessed oil sample are recorded in Table 1. Those samples which were treated in accordance with the process of the present invention left an ash which was generally light brown and soft in nature, as opposed to the hard dark colored ash obtained from the original oil. The lighter color is indicative of removal of the colored metal contaminants. The fact that the residue is soft is advantageous since the reprocessed oil, if used as a cheap fuel, would leave a soft residue afer burning which would be easily removed from the burners.

Turning to Table 1, it can be clearly seen that, in contacting the oil with an aqueous solution of ammonium sulphate, decreasing the pH of the aqueous solution through the addition of sulphuric acid increased the ash reduction. In contrast to this trend, teatment of the used oil with aqueous solutions of aluminum sulphate gave improved ash reduction upon increasing the pH with ammonium hydroxide. Further increases in ash reduction occurred when the used oil was contacted with ammonium sulphate and aluminum sulphate combined in an aqueous solution with a pH in the range of 3.5 to 4.0. The most efficient ash removal was achieved in combining the aluminum sulphate and ammonium sulphate in molar ratio of 1:3 respectively.

While the present invention has been disclosed in connection with the preferred embodiment thereof, it should be understood that there may be other embodiments which fall within the spirit and scope of the invention as defined by the following claims.

TABLE 1

CHEMICAL PRETREATMENT
Pretreatment at Elevated Temperature (375° F.) and Pressure (300 psig.)

| Pretreatment Chemical(s) | Mole Ratio in Solution | Solution pH | Product Ash % | Ash Reduction | Ash Properties |
|---|---|---|---|---|---|
| 0 | — | — | 1.53 | — | Red/brown - hard |
| $H_2O$ | — | 7.0 | 1.07 | 30.1 | Dark brown - hard |
| $H_2SO_4$ | — | 0.0 | 1.13 | 26.1 | Red/brown - hard |
| $H_2SO_4$ & $(NH_4)_2SO_4$ | 3:1 | 0.1 | 0.83 | 45.8 | Red/brown - hard |
| $H_2SO_4$ & $(NH_4)_2SO_4$ | 1:1 | 0.2 | 0.35 | 77.1 | Dark brown - hard |
| $H_2SO_4$ & $(NH_4)_2SO_4$ | 1:3 | 0.7 | 0.58 | 62.1 | Dark brown - hard |
| $(NH_4)_2SO_4$ | — | 5.6 | 0.80 | 47.7 | Grey - very hard |
| $(NH_4)_2SO_4$ & $NH_4OH$ | 1:1 | 9.7 | 1.00 | 34.6 | Brown - soft |

TABLE 1-continued

CHEMICAL PRETREATMENT
Pretreatment at Elevated Temperature (375° F.) and Pressure (300 psig.)

| Pretreatment Chemical(s) | Mole Ratio in Solution | Solution pH | Product Ash % | Ash Reduction | Ash Properties |
|---|---|---|---|---|---|
| $(NH_4)_2SO_4$ & $NH_4OH$ | 3:1 | 9.4 | 0.93 | 39.2 | Brown - soft |
| $(NH_4)_2SO_4$ & $NH_4OH$ | 1:2 | 9.9 | 1.25 | 18.3 | Light brown - soft |
| $Al_2(SO_4)_3$ | — | 3.0 | 0.94 | 38.5 | Light brown - soft |
| $Al_2(SO_4)_3$ & $NH_4OH$ | 3:1 | 3.2 | 0.81 | 47.0 | Light brown - soft |
| $Al_2(SO_4)_3$ & $NH_4OH$ | 1:1 | 3.4 | 0.56 | 63.4 | Light brown - soft |
| $Al_2(SO_4)_3$ & $(NH_4)_2SO_4$ | 1:1 | 3.6 | 0.42 | 72.5 | White - soft |
| $Al_2(SO_4)_3$ & $(NH_4)_2SO_4$ | 1:3 | 3.9 | 0.28 | 81.7 | Light brown - soft |
| $Al_2(SO_4)_3$ & $(NH_4)_2S)_4$ | 1:7 | 4.2 | 0.69 | 54.9 | Light brown - soft |
| $Al_2(SO_4)_3$ & $(NH_4)_2SO_4$ | 1:4 | 4.1 | 0.65 | 57.5 | White - soft |
| $Al_2(SO_4)_3$ & $H_2SO_4$ | 1:1 | 1.0 | 0.96 | 37.2 | Light brown - soft |

The embodiments of the invention in which an exclusive property or privilege is claimed are defined as follows:

1. A process for removing metal contaminants from used lubricating oil comprising:

contacting the lubricating oil with an aqueous solution of ammonium sulphate and aluminum sulphate in a closed vessel at elevated temperatue to form compounds of the metal contaminants separable from the oil in an aqueous phase; and separating said aqueous phase from the lubricating oil to provide an oil product reduced in metal contaminants.

2. The process as set forth in claim 1 wherein the ammonium sulphate and aluminum sulphate are used in excess of the concentration of the metal contaminants in the lubricating oil.

3. The process as set forth in claim 2 wherein the temperature is in the range of about 200° F. to 500° F.

4. The process as set forth in claim 3 wherein the pressure is that pressure resulting from a saturated steam atmosphere within the closed vessel at a temperature in the range of about 200° F. to 500° F.

5. The process as set forth in claim 4 wherein the temperature is about 375° F.

6. The process as set forth in claim 4 wherein the pH of the aqueous solution is in the range of about 3.5 to 4.0.

7. The process as set forth in claim 6 wherein the aqueous solution comprises about three molar parts ammonium sulphate and about one molar part aluminum sulphate.

* * * * *